US007081029B2

(12) United States Patent
Tagawa et al.

(10) Patent No.: US 7,081,029 B2
(45) Date of Patent: Jul. 25, 2006

(54) METHOD FOR FABRICATING VACUUM CONTAINER AND METHOD FOR FABRICATING IMAGE-FORMING APPARATUS USING THE VACUUM CONTAINER

(75) Inventors: Masahiro Tagawa, Kanagawa (JP); Osamu Takamatsu, Kanagawa (JP); Shinya Koyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 10/166,637

(22) Filed: Jun. 12, 2002

(65) Prior Publication Data

US 2002/0190633 A1 Dec. 19, 2002

(30) Foreign Application Priority Data

Jun. 15, 2001 (JP) ..... 2001-181599
May 31, 2002 (JP) ..... 2002-159501

(51) Int. Cl.
*H01J 9/00* (2006.01)
*H01J 9/26* (2006.01)
*H01J 9/40* (2006.01)

(52) U.S. Cl. ..... 445/24; 445/25

(58) Field of Classification Search ..... 445/24, 445/25; 313/495

See application file for complete search history.

(56) References Cited

U.S. PATENT DOCUMENTS 5,760,538 A 6/1998 Mitsutake et al. ..... 313/422
5,936,342 A 8/1999 Ono et al. ..... 313/495
5,984,748 A * 11/1999 Ritter et al. ..... 445/24
6,109,994 A * 8/2000 Cho et al. ..... 445/25
6,221,426 B1 4/2001 Yamanobe ..... 427/77
6,254,449 B1 7/2001 Nakanishi et al. ..... 445/25
6,278,234 B1 8/2001 Ono et al. ..... 313/495
6,309,272 B1 * 10/2001 Nishimura ..... 445/25
6,396,207 B1 * 5/2002 Hasegawa et al. ..... 313/495
6,722,937 B1 * 4/2004 Ludwig et al. ..... 445/25

FOREIGN PATENT DOCUMENTS

| | | | |
|---|---|---|---|
| EP | 0 926 696 A1 | | 6/1999 |
| JP | 7-302540 | | 11/1995 |
| JP | 8-180821 | | 7/1996 |
| JP | 9-82245 | | 3/1997 |
| JP | 9-237571 | | 9/1997 |
| JP | 11-250804 | | 9/1999 |
| JP | 2000021334 A | * | 1/2000 |
| JP | 2000-90829 | | 3/2000 |
| JP | 2000-90830 | | 3/2000 |
| JP | 2000-200543 | | 7/2000 |
| JP | 2000-251651 | | 9/2000 |
| JP | 2000-251654 | | 9/2000 |
| JP | 2000-251709 | | 9/2000 |
| JP | 2000-251769 | | 9/2000 |

* cited by examiner

*Primary Examiner*—Mariceli Santiago
(74) *Attorney, Agent, or Firm*—Fitzpatrick, Cella, Harper & Scinto

(57) ABSTRACT

A method that makes uniform the frame height after joining a frame and a substrate constituting the vacuum container of an image-forming apparatus without damaging the substrate surface in the vacuum container. A frame member is joined with a rear plate by applying frit glass to the rear plate, disposing a frame member on the frit glass, disposing a spacing definition member to a portion of the rear plate nearby the frame member where the vacuum container is not formed, pressurizing the frame member, and then softening the frit glass and thereby joining the frame member with the rear plate.

19 Claims, 14 Drawing Sheets

METHOD FOR FABRICATING VACUUM CONTAINER AND METHOD FOR FABRICATING IMAGE-FORMING APPARATUS USING THE VACUUM CONTAINER

BACKGROUND OF THE INVENTION

1. Field of the Invention

The present invention relates to a method for fabricating a vacuum container and a method for fabricating an image-forming apparatus using the vacuum container.

2. Related Background Art

In recent years, applied researches using an electron source constituted by arranging many electron discharge elements on a flat substrate have been extensively performed and for example, development of image-forming apparatuses such as an image display unit and an image recorder has been progressed. Particularly, a thin flat image display unit is watched as a substitute for a cathode-ray-tube display unit because it is space-saving and lightweight. As this type of the flat display unit, a display unit is proposed in which an electron-source substrate (rear plate) obtained by arranging electron discharge elements like a matrix and a face plate having a phosphor disposed so as to face the substrate are formed into an airtight container through a frame. For example, the structure of the display unit is disclosed in the official gazettes of Japanese Patent Application Laid-Open Nos. 08-180821 and 09-82245 and a method for fabricating the airtight container of the above display unit is disclosed in Japanese Patent Application Laid-Open Nos. 09-237571, 2000-090829, and 2000-090830.

In the case of a display unit having the above configuration, a faceplate and a rear plate may be jointed each other by using frit glass. The junction using frit glass is preferable because <1> sufficient airtight joining can be made to constitute a vacuum container and <2> dimensional errors of members (face plate, rear plate, and frame) are allowed because a buffering function is used. The function of the above <2> is particularly requested because a face plate, a rear plate, and a frame member are increased in size as a display unit is increased in size and thereby a shape strain or a dimensional error easily occurs in each of these members. Moreover, as a display unit is increased in size, a spacer may be used in an airtight container as an atmospheric-pressure-resistant structure. Because the spacer is located nearby electron emitting elements arranged at a high density, there were cases where <3> the spacer had a very high aspect ratio in its shape and <4> a film of high resistance (semiconductor film) was formed on the surface of the spacer to prevent an electrification on the surface of the spacer. When a high-temperature (e.g. approx. 400° C.) treatment such as a bonding step using frit is applied to the above spacer, a problem may occur that <5> the spacer is broken due to its shape or <6> characteristics of the anti-static treatment applied to the surface of the spacer may be changed. Moreover, the official gazette of Japanese Patent Application Laid-Open No. 2000-200543 discloses a display unit using a low-temperature jointing material and a display unit in which a low-temperature jointing material and frit glass are mixed. However, when using only a low-temperature jointing material, it is difficult to obtain the functions of the above <1> and <2>. Moreover, when frit glass is mixed, a jointing temperature rises and the problems of the above <5> and <6> occur.

SUMMARY OF THE INVENTION

In view of the above prior art, it is an object of the present invention to provide a vacuum container and a novel method for assembling a display unit using the vacuum container.

To achieve the above object, an aspect of the present invention provides a method for fabricating a vacuum container comprising:

a step of disposing a frame member on the main surface of a first substrate through a first jointing member;

a step of heating and thereby softening the first jointing member and then cooling and thereby solidifying the member and jointing the first substrate with the frame member by the first jointing material;

a step of disposing a spacer on the main surface of the first substrate with which the frame member is jointed; and a step of disposing a second substrate so as to face the main surface of the first substrate on which the spacer is disposed and jointing the second substrate with the frame member by a second jointing material having a melting point lower than that of the first jointing material.

Another aspect of the present invention provides a method for fabricating a vacuum container comprising:

a step of disposing a frame member on the main surface of a first substrate through a first jointing material;

a step of heating and thereby softening the first jointing material and then cooling and thereby solidifying the material and jointing the first substrate with the frame member by the first jointing material;

a step of disposing a second substrate to a spacer; and a step of disposing the second substrate on which the spacer is disposed so as to face the main surface of the first substrate with which the frame member is jointed and jointing the second substrate with the frame member by a second jointing material having a melting point lower than that of the first jointing material.

It is preferable that the first substrate is jointed with the frame member by disposing a spacing definition member higher than the frame member and lower than a frame member disposed through a first jointing material on the main surface of the first substrate and pressing gaps between the first substrate on which the frame members and the spacing definition member are disposed, the frame members, and the spacing definition member and thereby keeping the height of the frame member disposed through the first substrate and that of the spacing definition member almost the same. In this case, it is possible to control the sinking distance of the frame into the first jointing material. Therefore, even if using a jointing material having a low melting point for which a buffering function cannot be expected to joint the second substrate with the frame member to be performed later, it is possible to form a vacuum container having a high airtightness because the height of the frame member (height of junction face with second substrate) is uniform.

Moreover, it is preferable that the spacing definition member is disposed outside of the disposing position of the frame member on the main surface of the first substrate.

In this case, because the spacing definition member is disposed to a portion where the vacuum container is not formed, it is possible to prevent the substrate face inside of the disposing position of the frame (in the vacuum container) from damaging or dust from being produced. Therefore, it is possible to form a preferable vacuum container and fabricate an image-forming apparatus using the vacuum container.

Moreover, it is preferable that gaps between the first substrate, frame member, and spacing definition member are pressurized by an elevating unit.

In this case, because pressurization can be controlled, it is possible to uniformly pressurize a frame and resultantly, it is prevented that the entire upper face of the frame is diagonally jointed when assembling the frame. Therefore, this is more preferable.

It is still more preferable that the elevating unit has heating means.

Moreover, it is preferable that the first jointing material is made of frit glass. In this case, frit glass function as buffering materials and thereby, it is possible to absorb the warpage or strain of the frame member or substrate. In this connection, for the purpose of reducing damages to the electron emitting elements, it is preferable to apply the frit glass to the frame member. In this case, it is possible to reduce the number of heat-processing experiences to the electron emitting elements such as provisional baking etc.

It is preferable to further use a step of providing a getter material to the second substrate.

When providing the getter material to the substrate, it is preferable to perform a low-temperature treatment in order to avoid unnecessary activation of the getter material when assembled. Therefore, it is preferable to selectively provide a getter member to the second substrate to be jointed with the frame member by a low-melting-point jointing material (such as low-melting-point metal). Thereby, it is possible to keep the inside of the vacuum container in a vacuum state. Moreover, because a spacer is set in the vacuum container, a conductance may be deteriorated. However, deterioration of the conductance is solved by providing a getter to the second substrate and it is possible to sufficiently show the function of the getter. In a case of using a low-melting-point metal as the second jointing material such as a case were the second substrate has a getter, it is preferable to joint the first substrate with the frame member by using the above spacing definition member. Because it is impossible to expect the buffering function of frit glass for a low-melting-point metal, it is preferable to uniformly set frame heights by using the spacing definition member when jointing the first substrate (e.g. rear plate) with the frame.

It is preferable to use a jointing material made of a low-melting-point metal as a second jointing material in order to joint the second substrate with the frame.

It is preferable that gaps between the first substrate, frame member, and spacing definition member are pressurized by clips.

In this case, pressurization can be made by a simple method and a large-scale equipment is unnecessary. Therefore, for example, it is possible to form a plurality of vacuum containers in one furnace at the same time.

Moreover, still another aspect of the present invention in this specification is a method for fabricating an image-forming apparatus using a vacuum container and the vacuum container is fabricated by using the above fabrication method.

DESCRIPTION OF THE PREFERRED EMBODIMENTS

Embodiment 1

Then, an embodiment of the present invention is described below by referring to the accompanying drawings. However, a schematic configuration of a display unit which is an embodiment of an image-forming apparatus of the present invention is the same as that disclosed in the official gazette of Japanese Patent Application Laid-Open No. 09-82245, its description will be described later but jointing between a substrate, particularly, a rear plate (first substrate) and a frame and jointing between the rear plate and a spacer are mainly described below in detail.

Therefore, though a bonding step of a frame member when fabricating a display unit is described below by referring to FIGS. 1 to 11, the outline of an assembling system used for a frame jointing step is described below by referring to FIG. 2.

Figure 2:
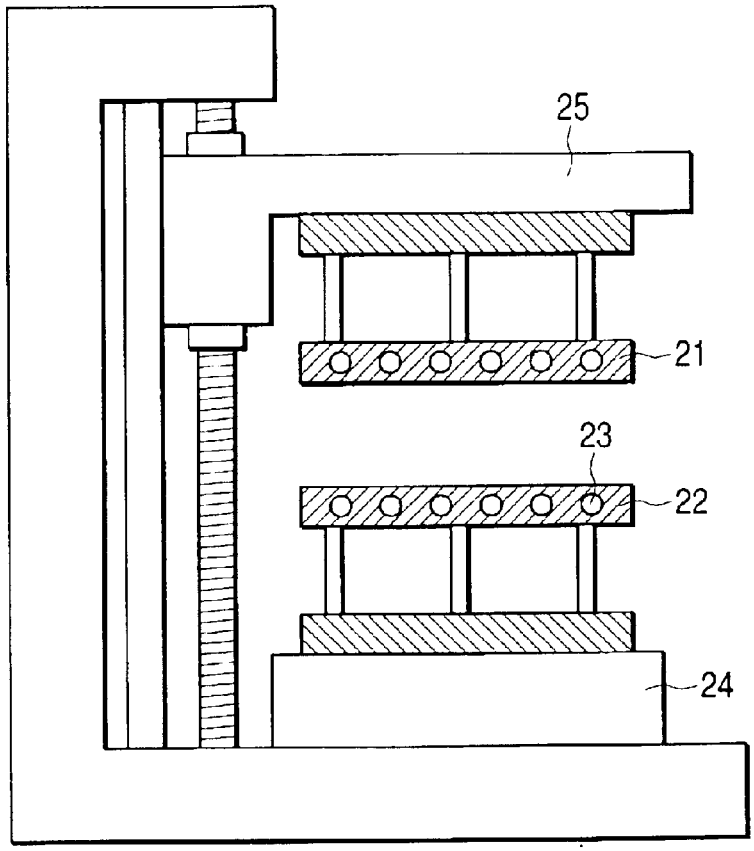
FIG. 2 is a block diagram of a hot-plate-type assembling system used to assemble a frame member of an image display unit that is an embodiment of the present invention.

FIG. 2 is a block diagram of a hot-plate-type assembling system used to assemble a frame member of a display unit which is an embodiment of the present invention, in which symbol 21 denotes an upper hot plate, symbol 22 denotes a lower hot plate, symbol 23 denotes a heater for raising temperatures of the hot plates 21 and 22.

The upper hot plate 21 is connected to an elevating unit 25 that can be vertically moved by rotating a ball screw. A pressurizing member is constituted by the upper hot plate 21 and the elevating unit 25. It is possible to uniformly pressurize the whole frame by the elevating unit in the direction vertical to the face of a rear-plate substrate. In the case of this embodiment, a hole for vacuum attraction is formed on the surface of the upper hot plate (face opposite to the surface of the lower hot plate) and thereby, it is possible to fix a substrate through vacuum attraction.

The lower hot plate 22 is fixed to an XY table 24 and it is possible to move the lower hot plate 22 in in-plane directions (two-axis orthogonal direction and rotational direction on the same plane as the surface of the lower hot plate) by moving the XY table 24.

A thermocouple (not illustrated) for measuring temperature is disposed to the upper and lower hot plates 21 and 22 and the heater 23 is feedback-controlled so that the upper and lower hot plates 21 and 22 have a desired temperature.

Air is discharged from a not-illustrated cooling unit under cooling to perform cooling by passing through a channel formed in a hot plate.

The elevating unit 25 can be vertically moved when an operator operates a controller (not illustrated).

A hot plate of a hot-plate-type assembling system used for this embodiment is made of stainless steel and a bar heater is disposed in the hot plate.

Figure 1:
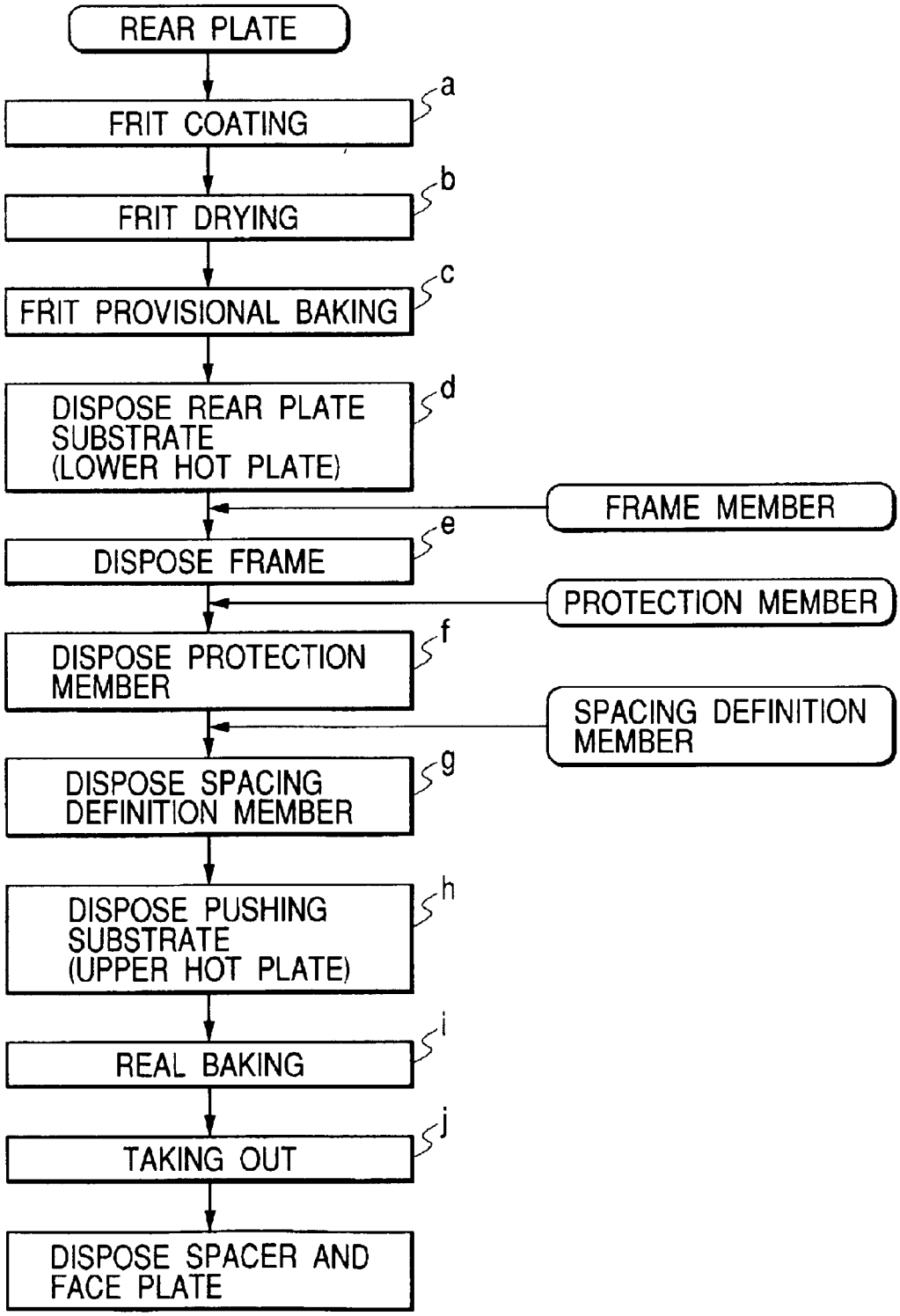
FIG. 1 is a process flowchart showing a frame-member assembling process of an image display unit that is an embodiment of the present invention.

A frame is jointed in accordance with FIG. 1 showing the process for assembling the frame member of the display unit of this embodiment by using the system having the above configuration.

FIGS. 3 to 11 explain the process flow shown in FIG. 1 more minutely.

FIGS. 4A, 5A, 6A, and 7A are illustrations when viewing a hot plate from the top and FIGS. 4B, 5B, 6B, and 7B are sectional views at the central portion of the hot plate.

The process for assembling the frame member of this embodiment is described below in detail in accordance with the steps a to j shown in FIG. 1. In the case of this embodiment, however, details of a rear-plate fabrication process are omitted.

a. Frit Coating (FIG. 3)

Figure 3:
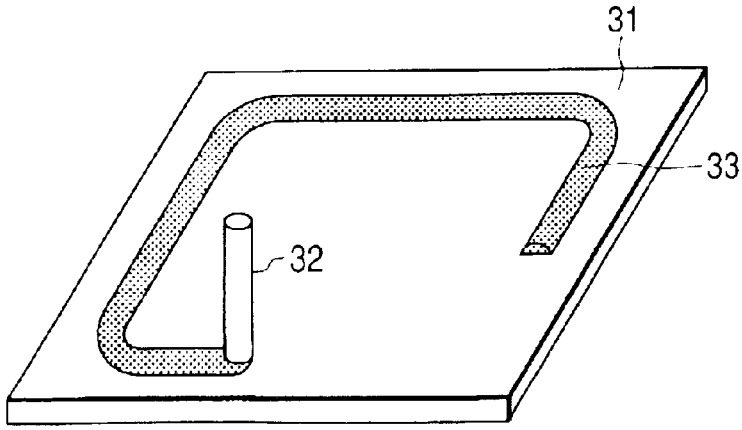
FIG. 3 is an illustration showing the state of applying frit glass in the process for assembling a frame member of an image display unit which is an embodiment of the present invention.

First, as shown in FIG. 3, frit glass (first jointing material) 33 is properly applied to the frame bonding position on the main surface of a rear-plate substrate 31 (formed by glass or the like) on which electron discharge devices are formed together with patterns of electrodes and wirings by a dispenser (FIG. 3 shows only a nozzle 32).

In this case, the frit glass 33 is used as paste by agitating and mixing frit glass powder and a vehicle (mixture of organic solvent and resin powder).

The frit-glass species is selected out of two types such as crystalline and amorphous species in accordance with the heat-treatment temperature in the subsequent step. Though not restricted, this embodiment uses CL23 (made by Asahi Techno Glass Corp.) which is crystalline frit glass as frit-glass powder.

The vehicle uses a mixture obtained by adding resin powder ELVACITE (made by DuPont Corp.) to terpineol which is an organic solvent at a ratio of 100:1 (wt %) and the frit glass and vehicle are agitated and mixed at a ratio of 10:1 to form paste.

The above resin powder ELVACITE is used to improve the coating property of the paste and a mixing ratio of it with the vehicle can be properly selected.

b. Frit Drying

The rear plate 31 coated with the above frit glass is dried in a drying furnace at 120° C. for 10 min.

c. Frit Provisional Baking

Moreover, the rear plate 31 is baked in a provisional baking furnace at 360° C. for 10 min. The provisional baking is a thermal treatment for separating and removing the vehicle component used to form the paste. The frit glass powder is temporarily melted at a softening temperature by the above treatment and then formed as a solid after the treatment.

d. Rear Plate Disposing (Lower Hot Plate) (FIGS. 4A and 4B)

Figure 4A:
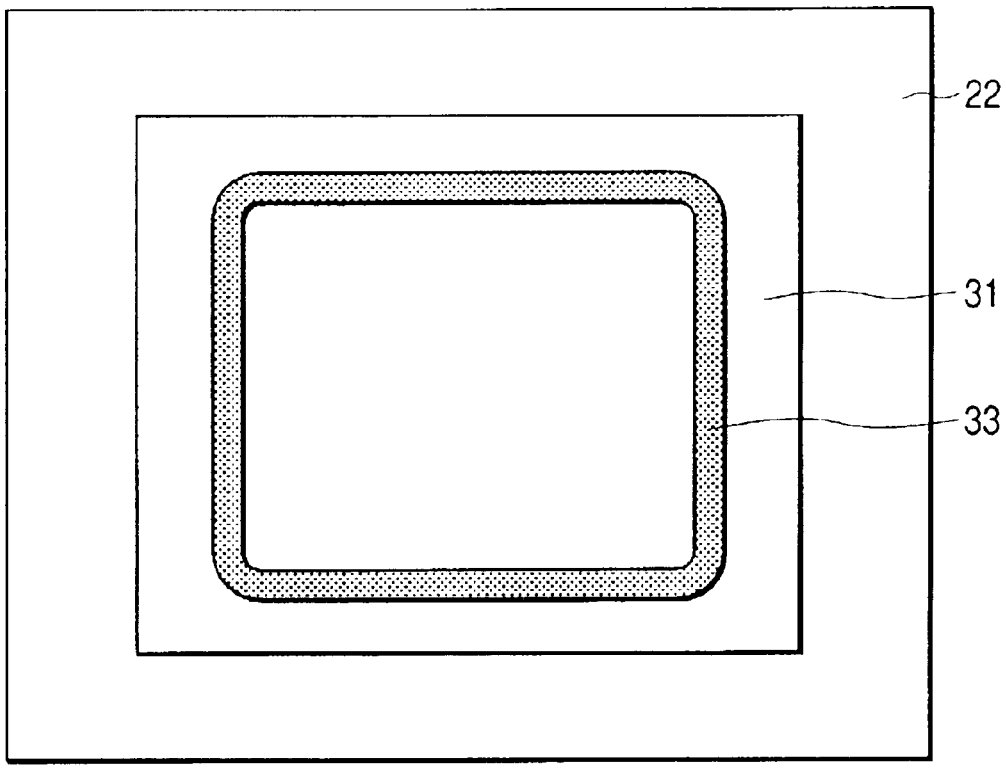
FIGS. 4A and 4B are illustrations showing the state of disposing a rear plate to a lower hot plate in the process for assembling a frame member of an image display unit which is an embodiment of the present invention.
Figure 4B:
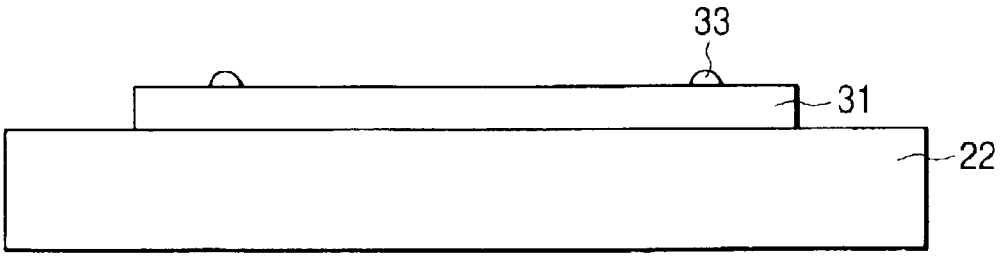

As shown in FIGS. 4A and 4B, the rear plate 31 to which the above frit provisional baking is applied is disposed on the lower hot plate 22 of the hotplate-type assembling system (FIG. 2). In this case, the rear plate 31 is fixed to a desired position by a fixing jig (not illustrated) provided on the lower hot plate 22.

e. Frame Disposing (FIGS. 5A and 5B)

Figure 5A:
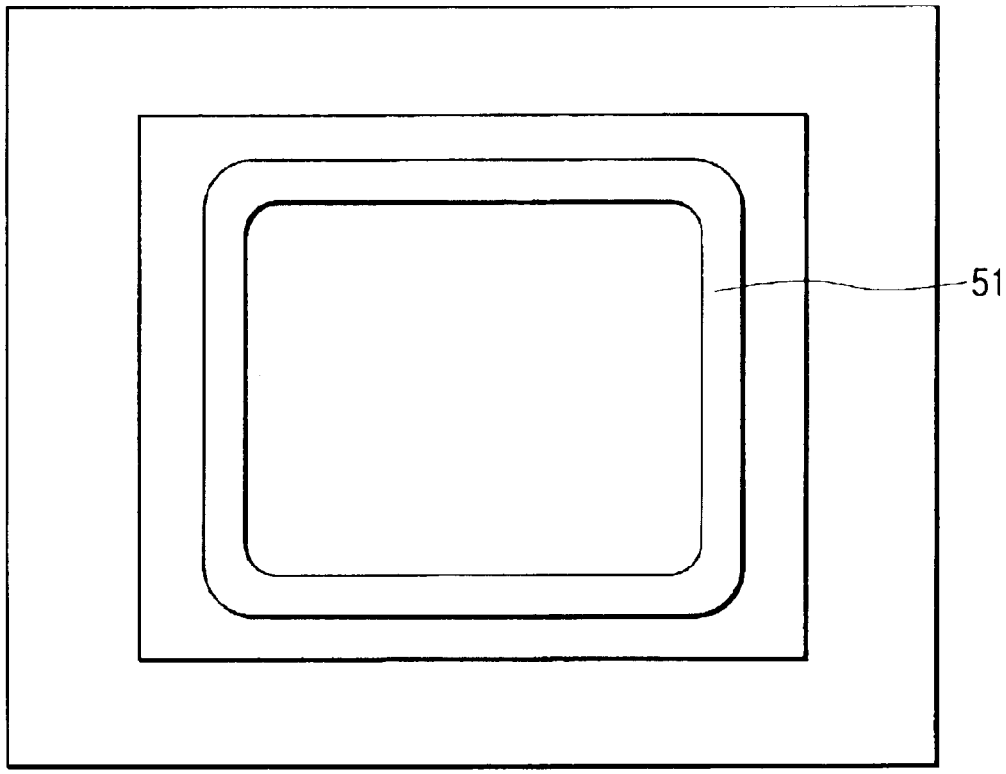
FIGS. 5A and 5B are illustrations showing the state of disposing a frame member onto a rear plate in the process for assembling a frame member of an image display unit which is an embodiment of the present invention.
Figure 5B:
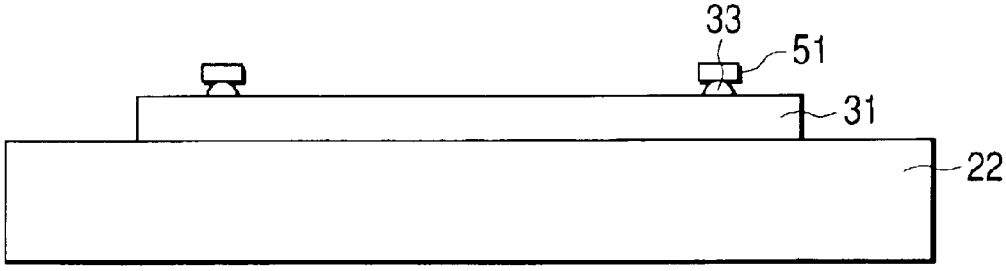

As shown in FIGS. 5A and 5B, a frame member 51 is disposed on the frit glass 33 provided for the main surface of the rear plate (first substrate).

The frame member 51 is fabricated by cutting a glass plate having a thickness of 1.1 mm and an In base layer (Ag layer) is formed by applying Ag paste to either side of the member 51 by the printing method and baking it. Moreover, as described later, In of a low-melting-point metal is formed on the Ag layer in the subsequent step and a frame and a face plate are sealed through the In to form a vacuum container.

The frame member 51 is disposed on the frit glass 33 so that the glass face of the frame member 51 {side where the above In base layer (Ag layer) is not provided among ends of the frame member} contacts the frit glass 33.

After disposing the frame member 51, positioning is performed by using a not-illustrated positioning jig so that the member 51 is brought to a predetermined position of the rear plate 31.

The frame member 51 uses the same material as the rear plate 31.

f. Protection Member Disposing (FIGS. 6A and 6B)

Figure 6A:
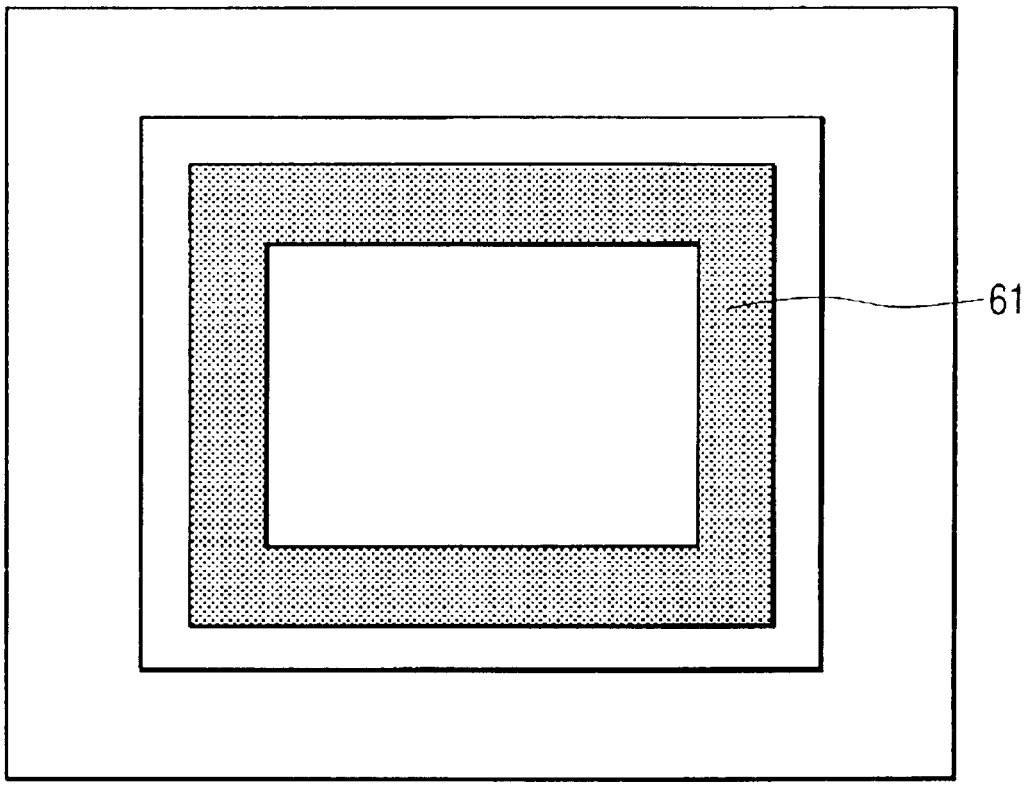
FIGS. 6A and 6B are illustrations showing the state of disposing a protection member onto a frame member in the process for assembling a frame member of an image display unit which is an embodiment of the present invention.
Figure 6B:
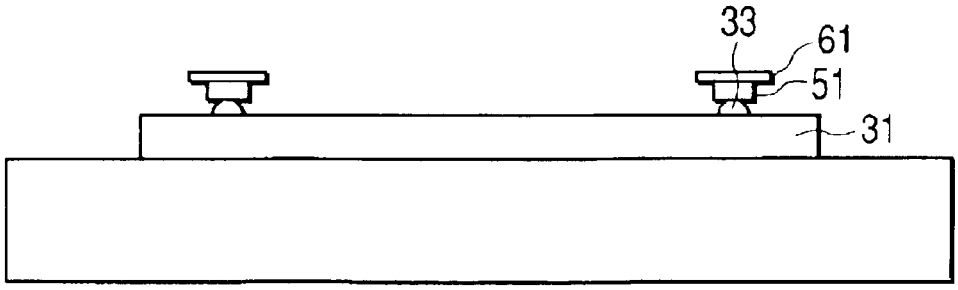
Figure 7A:
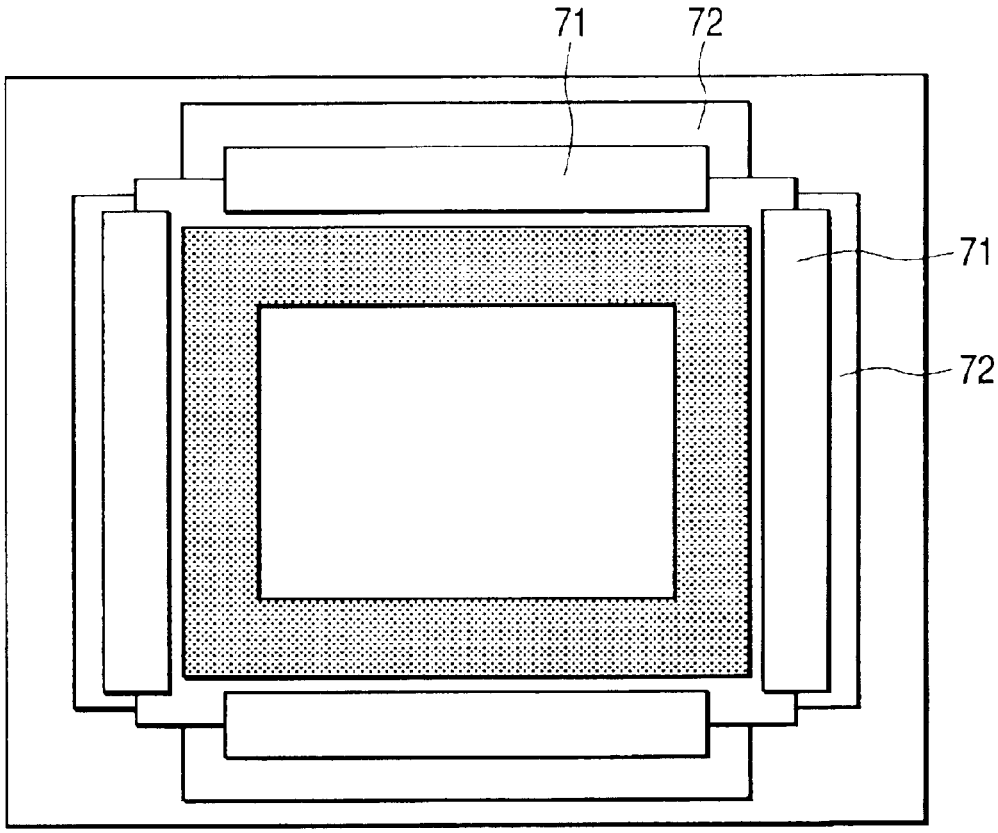
FIGS. 7A and 7B are illustrations showing the state of disposing a spacing definition member in the process for assembling a frame member of an image display unit which is an embodiment of the present invention.
Figure 7B:
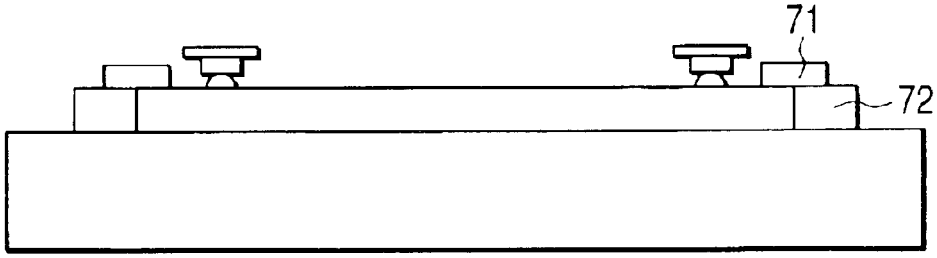

As shown in FIGS. 6A and 6B, a protection member 61 is disposed on the Ag layer of the frame member 51. After disposing the protection member 61, positioning is performed by using a not-illustrated positioning jig so that the member 61 is brought to a predetermined position of the frame member 51.

The protection member 61 is used to protect the In base layer (Ag layer) applied to the frame member 51 so that the layer does not adhere to a pushing substrate to be described later.

It is preferable that the member 61 uses a material other than glass having thermal expansion almost same as that of the rear plate 31. In the case of this embodiment, a sheet made of a 426 alloy (42% Fe—6% Ni—Cr Cr alloy) and having a thickness of 0.15 mm formed into the same shape as the frame member 51 (but having a width larger than that of the member 51). A material other than glass is used because the Ag printing thick film serving as an In base treatment layer used for this embodiment easily adheres to glass at a high temperature in a pressurized state.

g. Spacing Definition Member Disposing (FIGS. 7A, 7B, 8A and 8B)

As shown in FIGS. 7A, 7B, 8A and 8B, an auxiliary member 72 having a thickness same as or slightly smaller than that of the rear plate (first substrate) 31 is disposed around the rear plate 31.

Moreover, a spacing definition member 71 is disposed so as to concern the end on the main surface of the rear plate 31 and the auxiliary member 72.

In the case of this embodiment, because the rear plate 31 has a thickness of 2.8 mm, two types of the auxiliary members 72 having a thickness of 2.75 mm, width of 30 mm, and lengths of 600 and 900 mm (made of glass) are disposed to the major side and minor side of the rear plate 31 respectively.

Spacing definition members 71 having a thickness of 1.57 mm, width of 10 mm, and lengths of 500 and 800 mm (made of glass) are used.

Figure 8A:
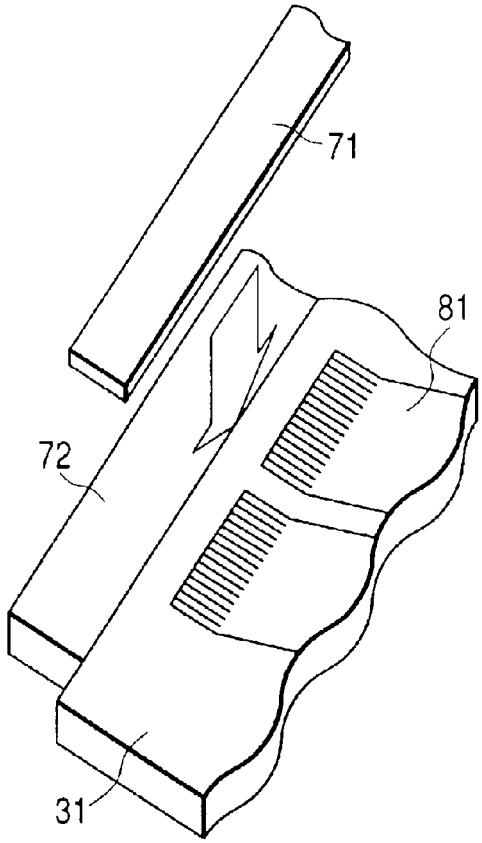
FIGS. 8A and 8B are illustrations for explaining the state of disposing the spacing definition member in FIGS. 7A and 7B in detail.
Figure 8B:
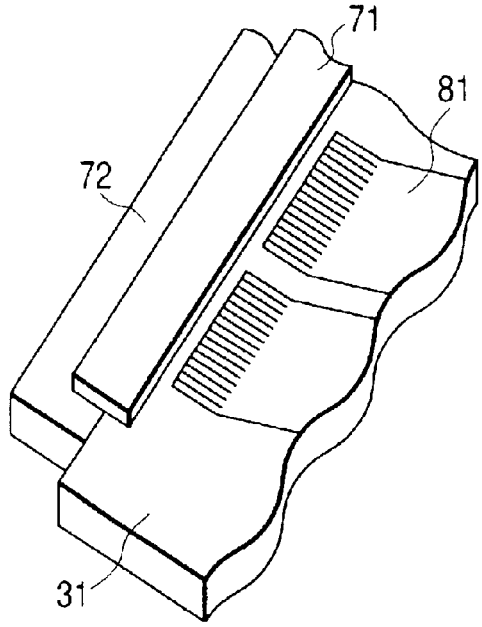

As shown in FIGS. 8A and 8B, the spacing definition member 71 is mounted on the main surface of the rear plate 31 (auxiliary member 72) so as to contact the glass face by avoiding a wiring 81 in order to prevent a wiring 82 from being damaged due to the spacing definition member 71.

Moreover, the auxiliary member 72 is disposed to stabilize the spacing definition member 71.

In the case of this embodiment, because the circumference of a substrate (place free from wiring) is selected as a place where the spacing definition member 71 will be disposed), the width of the place on which the member 71 can be dispose is small. Therefore, the width is set to 10 mm by considering that when disposing a spacing definition member having a width of 5 mm or less to the place, the spacing definition member may be broken because of an insufficient strength. Therefore, a half or more of the width of the spacing definition member 71 is projected from the rear plate 31 and resultantly the member 71 becomes unstable. Thus, the auxiliary member 72 is disposed below the spacing definition member 71 in order to stabilize it.

Figure 12A:
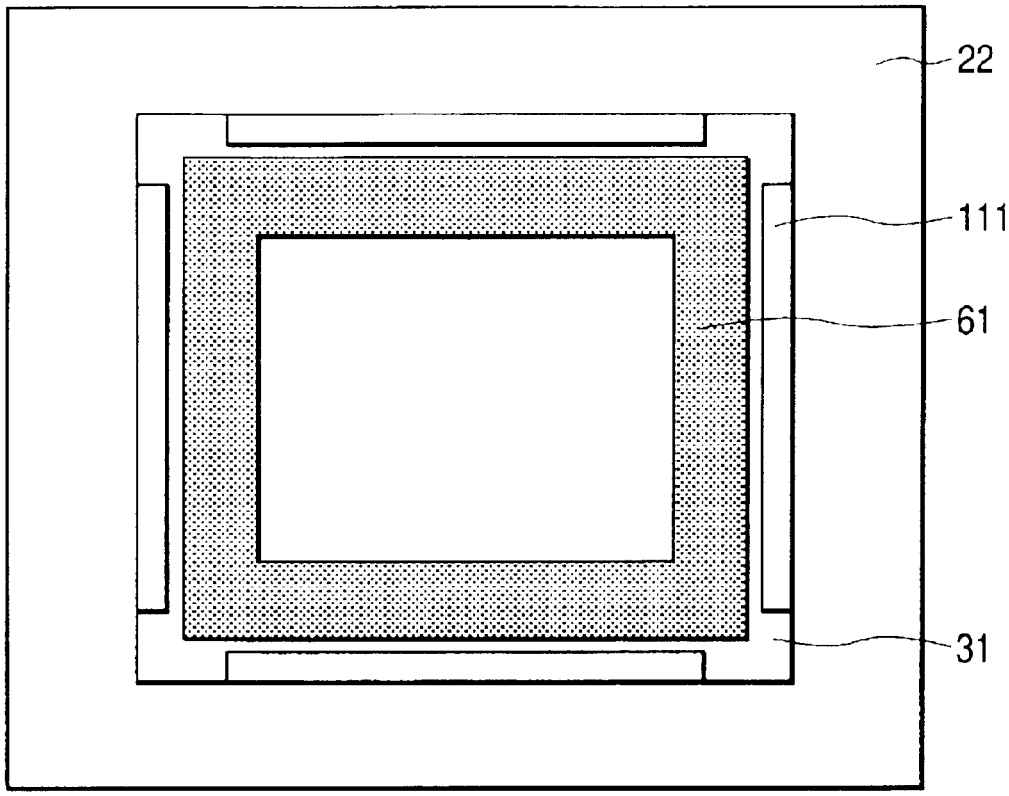
FIGS. 12A and 12B are illustrations explaining a configuration when using another spacing definition member in the process for assembling a frame member of an image display unit which is an embodiment of the present invention.
Figure 12B:
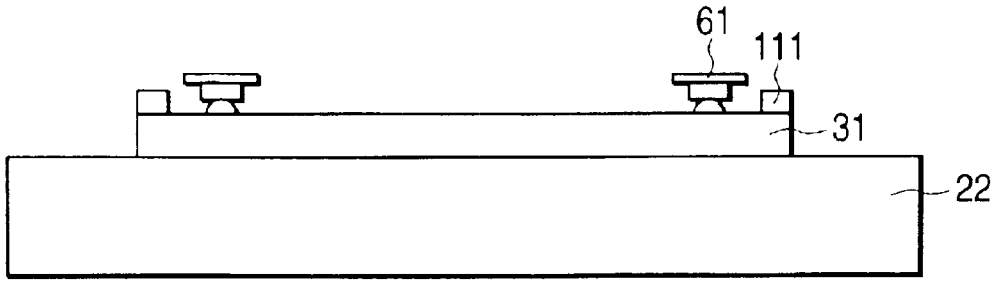

Unless a spacing definition member has a problem of strength, it is possible to use the configuration having no auxiliary member as shown in FIGS. 12A and 12B.

h. Pushing Substrate Disposing (Upper Hot Plate) (FIG. 9A)

Figure 9A:
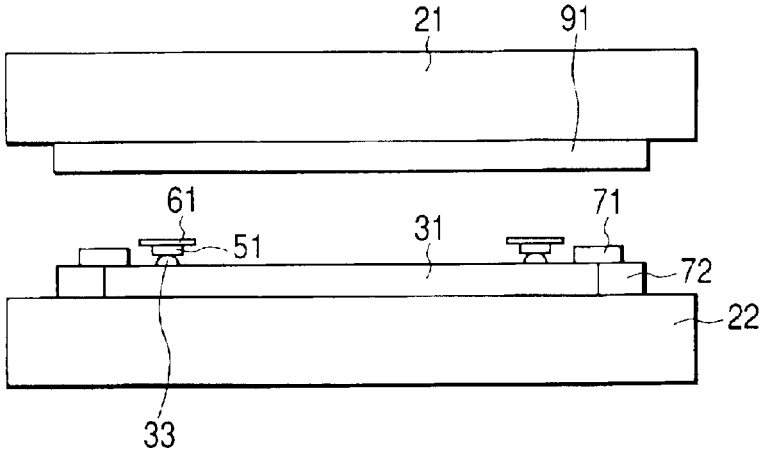
FIGS. 9A, 9B and 9C are illustrations showing the state of bonding a frame member of an image display unit which is an embodiment of the present invention through real baking of frit glass after disposing a pushing substrate to an upper hot plate in the process for assembling the frame member in the process for assembling a frame member of an image display unit which is an embodiment of the present invention.

Then, as shown in FIG. 9A, the upper hot plate 21 is made to vacuum-attract a pushing substrate 91.

The pushing substrate 91 uses glass same as the material of the rear plate 31.

The pushing substrate is used because extension or contraction of the upper hot plate 21 due to thermal expansion when heated may damage the spacing definition member 71 or protection member 61 and in order to prevent foreign matter (such as frit glass) from attaching to the upper hot plate 21.

i. Real Baking (FIGS. 9A to 9C and FIG. 10)

Figure 10:
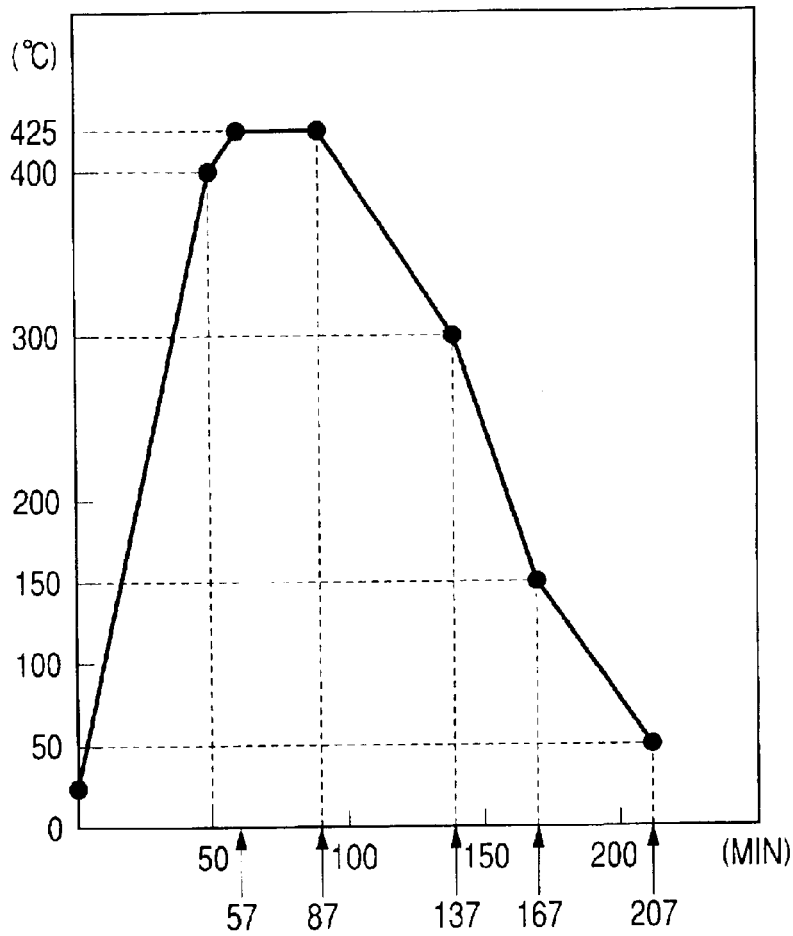
FIG. 10 is an illustration showing a temperature profile when bonding a frame member through real baking of frit glass.

Frit glass is really baked to bond a frame member at the temperature profile shown in FIG. 10.

In this case, a load is applied to the frame member 51 by operating an elevating unit in accordance with the temperature profile and lowering the upper hot plate 21. In this case, it is possible to control the load by the elevating unit and vertically apply a load to the rear-plate substrate face (upper face of a frame). Therefore, even if disposing a spacing definition jig to the outside of the frame (portion outside of vacuum container on a face opposite to a face plate of a rear plate), it is possible to prevent that the entire upper face of the frame from being diagonally jointed.

The relation between temperature and load is described below.

Before temperature reaches the temperature of 400° C., a gap of approx. 1 mm is formed between the protection member 61 disposed on the frame member 51 and the pushing substrate 91 vacuum-attracted by the upper hot plate 21 (FIG. 9A).

Figure 9B:
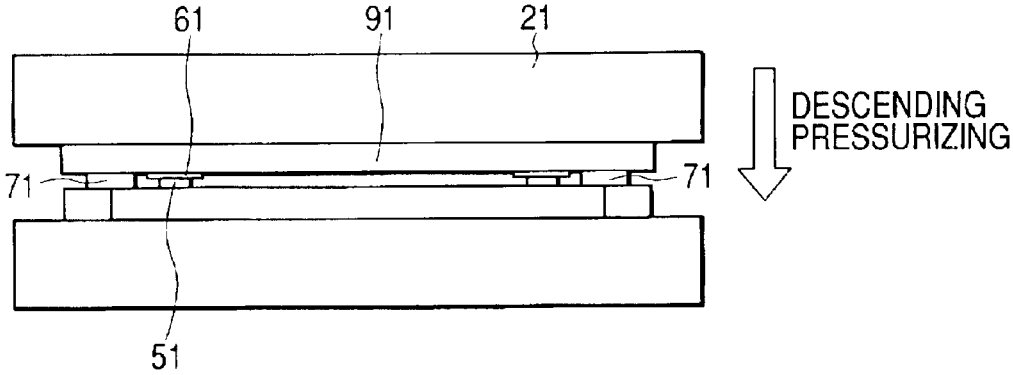
Figure 9C:
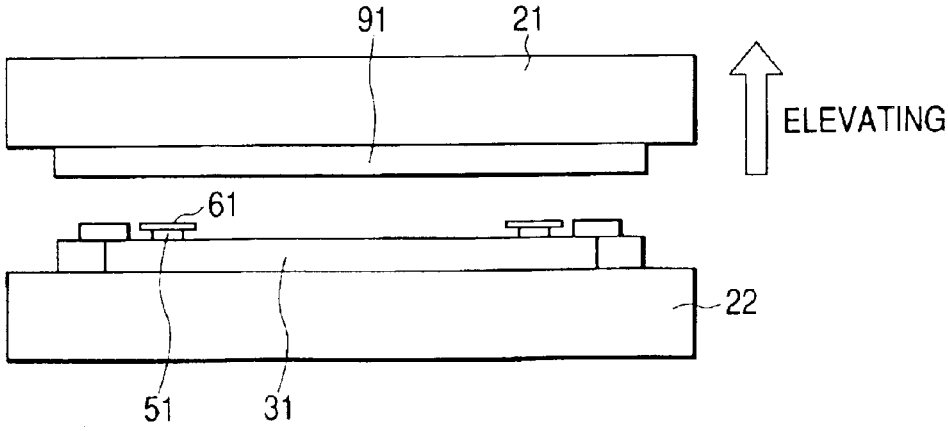

The upper hot plate 21 is lowered at 400° C. to bring the pushing substrate 91 into contact with the protection member 61 (FIG. 9B). In this case, a load of approx. 20 kg is applied to the frame member 51.

When the temperature reaches 425° C. the load is increased to 100 kg. Thereby, frit glass is completely crushed and the frame member 51 is pushed up to the height specified by the spacing definition member 71.

Figure 11:
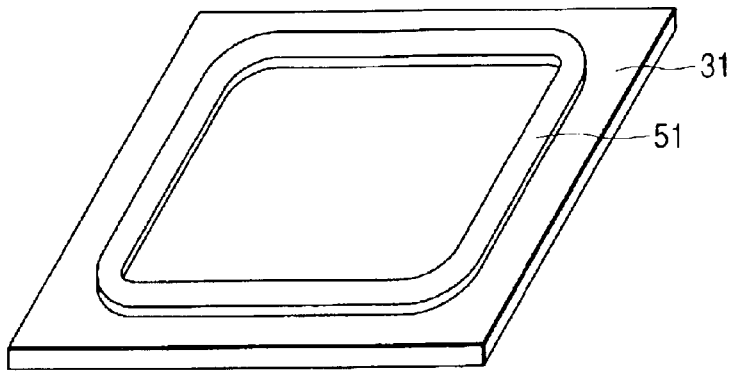
FIG. 11 is an illustration showing a rear plate taken out after real baking in the process for assembling a frame member of an image display unit which is an embodiment of the present invention.

The load is decreased to approx. 20 kg after cooling is started. This state is kept until the temperature reaches ordinary temperature (load of 20 kg; pushing substrate 91 contacts with protection member 61).

j. Taking-Out (FIG. 11)

After real baking, the upper hot plate 21 is raised to take out the rear plate 31 from the lower hot plate 22. FIG. 11 shows the taken-out rear plate 31.

To take out the rear plate 31, the protection member and spacing definition member are removed from the surface of the frame member 51.

After passing through the above processes, the frame member 51 is bonded to a desired position of the rear plate 31 with frit glass.

In the case of this embodiment, it is possible to bond the frame member 51 at the average height of 1.365 mm from the rear-plate glass surface up to the surface of the In base layer (Ag layer) and an accuracy of 0.1 mm in range.

When desired value and range are not satisfied depending on the flatness of a hot plate, it is possible to adjust the flatness by setting a metallic shim correspondingly to the highest portion of the frame member. In this case, the metallic shim is disposed between the lower hot plate and the rear plate.

It is preferable to use a metallic shim which has a small heat capacity and does not attach (is not bonded) to a hot plate or glass substrate. Therefore, an aluminum plate or stainless-steel plate is used as the shim.

Figure 13:
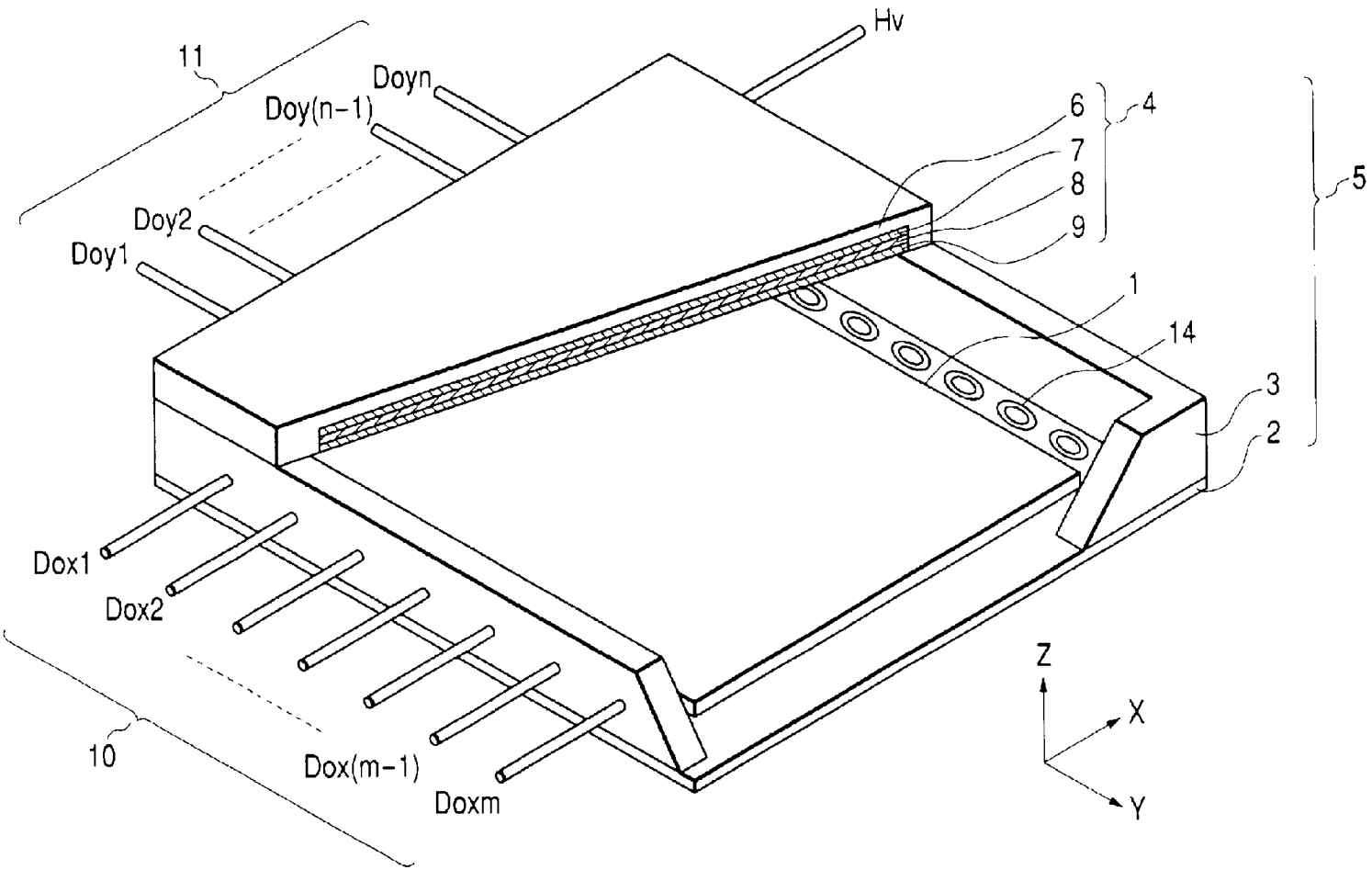
FIG. 13 is a schematic block diagram of a display unit of the present invention.
Figure 14:
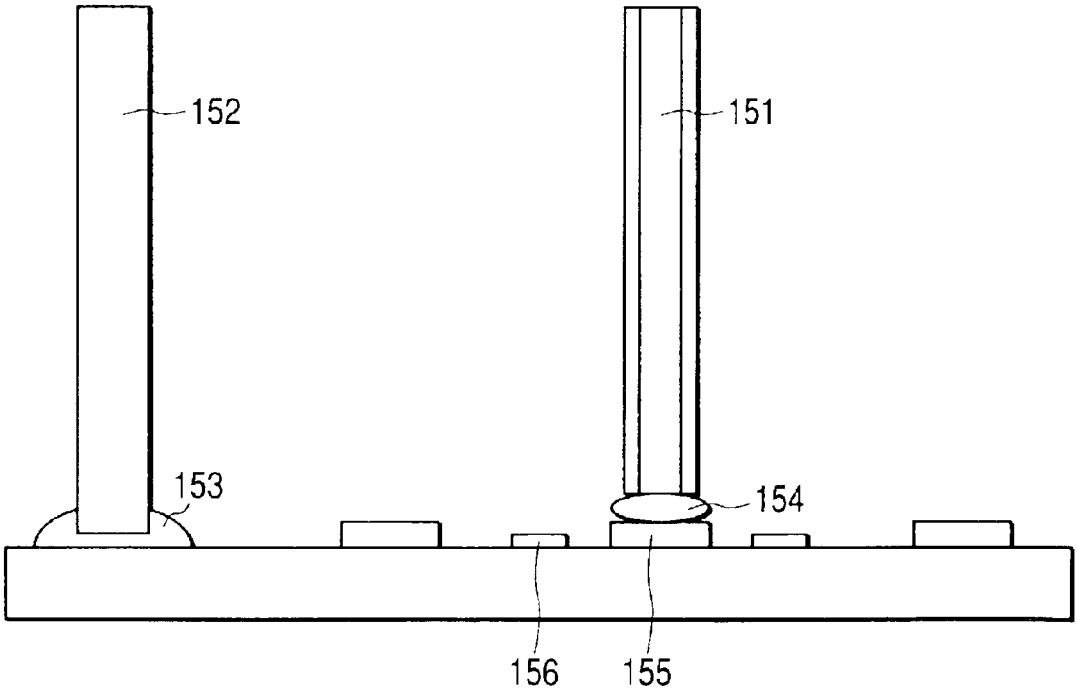
FIG. 14 is a locally enlarged view of a display unit of the present invention.

After the above frame-member bonding step, an electron-source element is formed and activated and then, In (second jointing material) is applied onto the frame member, and then a spacer for supporting the gap between the face plate and the rear plate is disposed. Disposing of the spacer is described below in detail. The spacer uses a spacer in which a film for preventing electrification is formed on a glass base material similarly to the case of Japanese Patent Application Laid-Open No. 08-180821. Moreover, the spacer 151 is bonded onto a wiring 155 electrically connected with the electron emitting element 156 of a rear plate by using an inorganic adhesive bondable at a low temperature {in the case of this embodiment, ARON CERAMIC made by TOAGOSEI CO., LTD. is used}. The inorganic adhesive 154 is applied in a sufficiently thin thickness and in a dispersing manner with a space internal to the end of the spacer so that electrical connection is made through partial contacts between the spacer and wiring. FIG. 14 shows a local sectional view of the rear plate on which the spacer is thus disposed. Moreover, finally, the rear plate is baked in a vacuum sealing system and a face plate is jointed with the rear plate on which the frame 152 and the spacer 151 are disposed and formed into a panel by sealing the rear plate with a face plate on whose face opposite to the rear plate a getter is formed through In applied onto the above frame member. In this case, sealing is performed under a reducedpressure environment at 180° C. that is slightly higher than the melting point of In. FIG. 13 shows a schematic view of the display unit thus formed. (In this case, the spacer is not illustrated.) Disposing of the spacer is not restricted to the above case. It is also allowed to form a panel by bonding the spacer to a desired position of the face plate with the above inorganic adhesive, aligning the face plate on which the spacer is disposed with the rear plate on which the above frame member is disposed, and sealing the plates through In applied onto the frame member. Thus, it is allowed that a step of disposing a spacer to a first substrate is executed after bonding a frame member to the first substrate by using a first jointing material 153 having a melting point hither than that of a second jointing material. Thereby, it is possible to perform the airtight jointing by the first jointing material and the jointing allowing dimensional errors of the frame member, face plate, and rear plate while preventing bad influences on a spacer member due to heat.

Thus, it is possible to fabricate a preferable image display unit.

The present invention can be applied not only to the above image display unit but also to an image recorder requiring a vacuum container.

Embodiment 2

Then, embodiment 2 of the present invention is described below. In the case of this embodiment, steps from the step h downward in the above first embodiment are different. Therefore, only different steps are described below. The embodiment 2 uses a clip as pressuring means and a baking furnace as baking means. Then, steps from the step h downward of this embodiment are described below.

h. (Clip Fixing Step)

Figure 16:
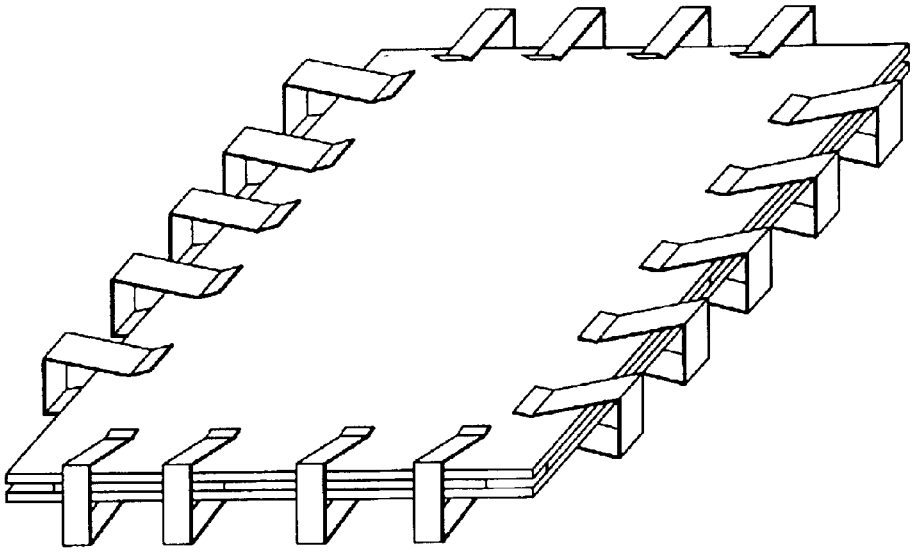
FIG. 16 is a perspective view for explaining pressurization in the second embodiment of the present invention.

The spacing definition member 71, frame 51, and rear plate 31 assembled as described above are fixed by clips 92. The clip 92 are uniformly disposed at four sides so that a uniform pressure can be applied to the whole frame 51 (refer to FIG. 16).

The clip 92 is used to fix the position of the frame 51 and pressurize frit glass (first jointing material) 33 in a heating step to be described later and therefore, it has heat resistance and a desired spring force. Therefore, a material is not restricted as long as the material satisfies the above conditions. A clip made of a heat-resistant metallic panel material such as Inconel is generally used. This embodiment uses 20 metal clips made by MITSUBISHI MATERIALS CORP. (material: MA750 (trade name), width of spring-pressurizing portion: 30 mm, and spring force: approx. 3 kg at a spreading value of 7 mm) and has the total load of 30 kg. The total load is decided in accordance with the viscosity of the frit glass 33 when it is melted and properly adjusted in accordance with the type of the frit glass 33. Moreover, by adjusting the number of clips 92 and the spring force, it is possible to easily and accurately set a pressure applied to the frit glass 33.

i. (Heating and Pressurizing Step)

Figure 15A:
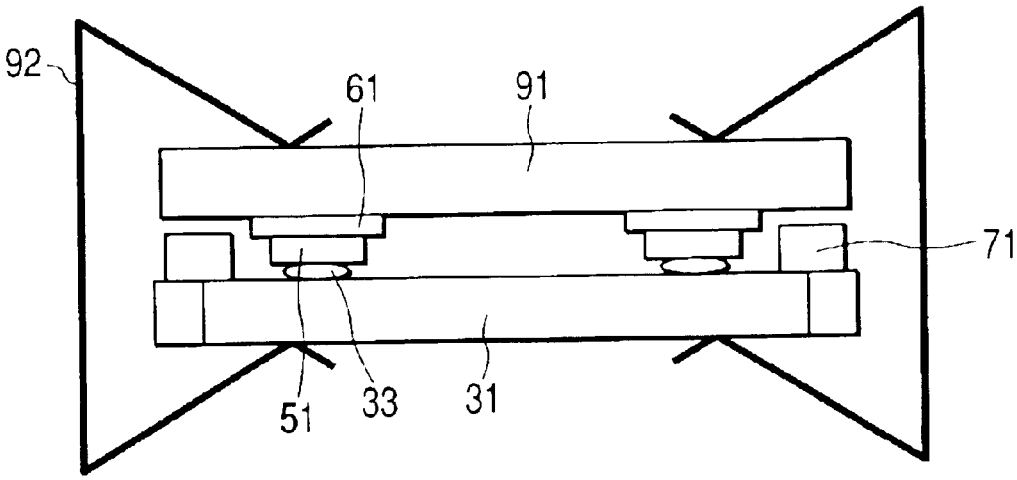
FIGS. 15A and 15B are illustrations for explaining pressurization in second embodiment of the present invention.
Figure 15B:
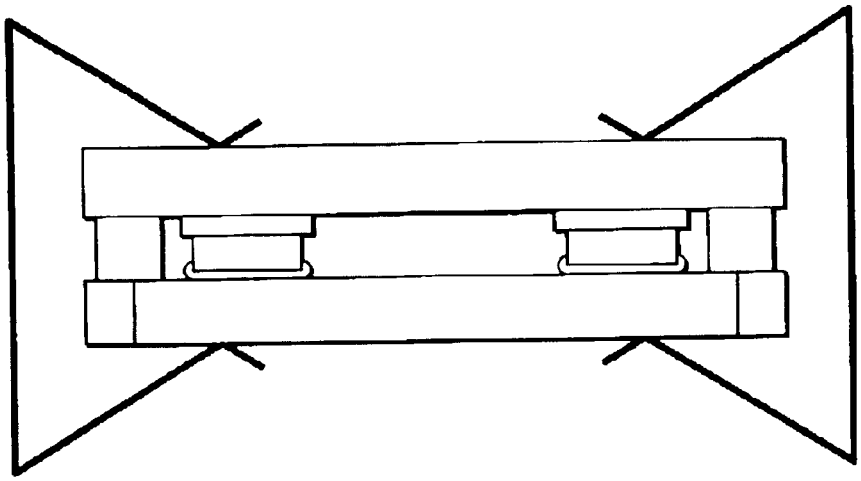

The spacing definition member 71, frame 51, and rear plate 31 fixed by the clip 92 as described above are disposed in an electric furnace. Then, the temperature in the furnace is raised and kept at 425° C. for 30 min in the case of this embodiment. The frit glass 33 is softened through the above heating and pressurized until the spacing definition member 71 contacts the pushing substrate 91 by the pressure of the clip 92 while the glass 33 is softened as shown in FIG. 15B. Thus, while the frit glass 33 closely contacts with the rear plate 31 and frame 51, the total thickness of the protection member 61, frame 51, and frit glass 33 in a laminated state is specified by the spacing definition member 71. Then, they are cooled, the frit glass 33 is crystallized and solidified to fix the frame 51 and rear plate 31.

Figure 17:
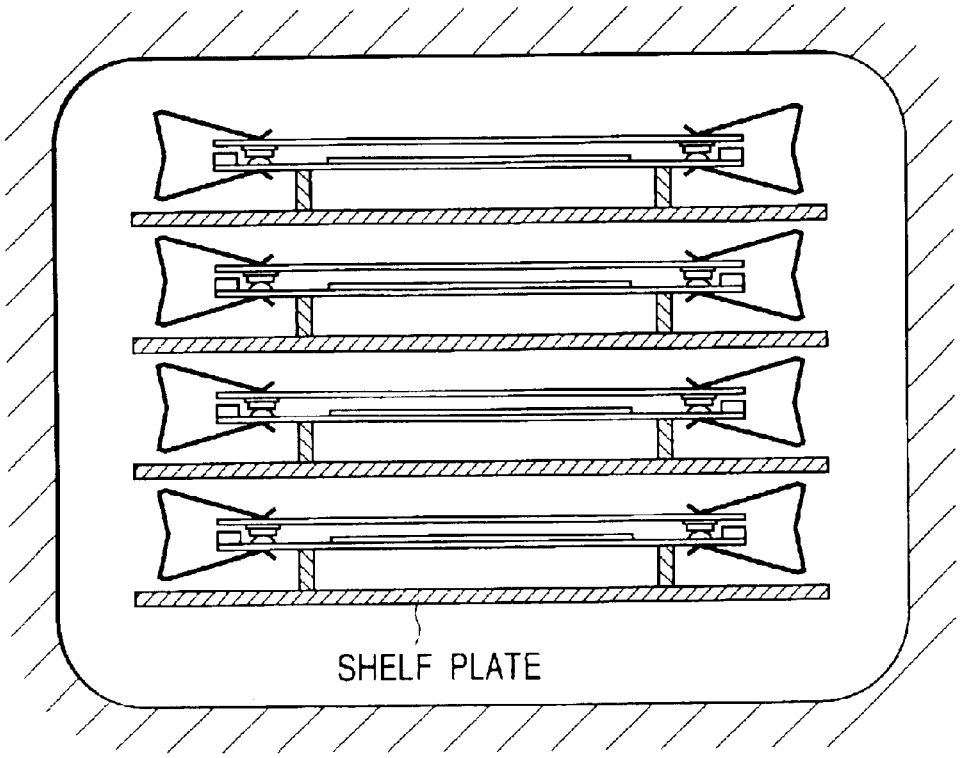
FIG. 17 is an illustration for explaining a treatment in an electric furnace in the second embodiment of the present invention.

The electric furnace generally uses a hot-air-circulation-type furnace. However, if temperature distributions fluctuate, the electric furnace may be broken due to the difference between expansion and contraction due to the temperature difference between portions of the rear plate 31. Therefore, an electric furnace is used which has a structure in which hot air evenly circulates through the rear plate 31 and frame 51 and uniform heating is realize. Moreover, by using an electric furnace, the batch treatment of many members (10 to 20 members according to circumstances) is possible at the same time as shown in FIG. 17. Moreover, as shown in FIG. 17, the structure of the electric furnace is not restricted to a structure in which the rear plate 31 is horizontally put as shown in FIG. 17 but it is allowed to use a structure in which the rear plate 31 is vertically put.

A temperature rise rate and a temperature drop rate in an electric furnace is decided by considering breakage of the rear plate 31 due to fluctuation of temperature distributions or reduction of the residual stress of thermal strain. In the case of this embodiment, the temperature rise rate is controlled to approx. 10° C./min and the temperature drop rate is controlled to approx. 2° C./min.

(Spacing-Definition-Jig Removing Step)

After the inside of the electric furnace is cooled to 50° C. or lower, the spacing definition member 71, frame 51, and rear plate 31 fixed by the clip 92 are carried out from the electric furnace. Then, the clip 92 is removed. At this point of time, the rear plate 31 and frame 51 are fixed by the frit glass 33. It is preferable to remove the clip 92 simultaneously with a plurality of clips 92 at symmetric positions so that the rear plate 31 is not broken when a biased pressure is applied to the rear plate 31.

Then, similarly to the case of the embodiment 1, the electron source element is formed and activated, then, In (second jointing material) is applied onto the frame member, then the spacer for supporting the gap between the face plate and the rear plate is assembled and finally baked in the vacuum sealing system, the frame-provided rear plate and the face plate are sealed through In applied onto the frame member, thereby the face plate and the rear plate are jointed each other and formed into a panel (FIG. 13).

Thus, it is possible to fabricate a preferable image display unit.

Moreover, the embodiment 2 can be applied not only to the above image display unit but also to an image recorder requiring a vacuum container.

(Image Display Unit)

Then, a display unit having the same configuration as the image display unit disclosed in the official gazette of Japanese Patent Application Laid-Open No. 09-82245 to which the fabrication method of the above embodiment 1 or 2 of the present invention (a bonding step of a frame member and a spacer) is described below by referring to FIG. 13.

In FIG. 13, symbol 2 denotes a rear plate serving as the bottom of a container, 4 denotes a face plate, 3 denotes a support frame for supporting the gap between the face plate 4 and the rear plate 2. These members 2 to 4 constitute a vacuum container (airtight container) for keeping the inside of the display unit in a vacuum state.

To assemble the airtight container, it is necessary to seal members in order to keep sufficient strength and airtightness of the joint between members. As described above, in the case of this embodiment, sealing is achieved by using frit glass for the jointing (sealing) material (first jointing material) between the rear plate 2 and support frame 3 and using a low-melting-point metal for the jointing (sealing) material (second jointing material) between the face plate 4 and support frame 3. As described above, the frame member is jointed to the rear plate and then, the spacer is disposed to the rear plate.

N×M surface-conduction-type emitting elements respectively serving as an electron source 1 are formed on the rear plate 2. (N and M are positive integers of 2 or more, which are properly set in accordance with the purpose number of display pixels. In the case of this embodiment, N is set to 1,440 and M is set to 480.) The above N×M surface-conduction-type emitting elements are connected like a simple matrix by M row-directional wires and N column-directional wires. The portion thus constituted is referred to as a multiple electron-beam source.

Moreover, symbols D0x1 to D0xm, D0y1 to D0yn, and Hv respectively denote an electrical connection terminal having an airtight structure provided to electrically connect the display panel with a not-illustrated electric circuit. D0x1 to D0xm of a row selection terminal 10 electrically connect with row directional wires of the multiple electron-beam source, D0y1 to D0yn of a signal input terminal 11 electrically connect with column directional wires of the multiple electron-beam source, and the high-voltage terminal Hv electrically connects with an anode electrode serving as a metal-back 8 of the face plate 4.

Then, The multiple electron-beam source used for the display panel is described below.

In the case of the multiple electron-beam source used for an image display unit of the present invention, the material, shape, or fabrication method of a cold cathode is not restricted as long as the multiple electron-beam source is an electron source in which cold cathodes are disposed like a simple matrix or ladder. Therefore, it is possible to use surface-conduction-type emitting elements or FE- or MIM-type cold cathodes for the multiple electron-beam source.

However, a surface-conduction-type emitting element is particularly preferable among these cold cathodes when an inexpensive display unit having a large display screen is requested. That is, the FE type requires a very-accurate fabrication art because relative positions of an emitter cone and a gate electrode or shapes of them greatly influence the electron emitting characteristic. However, this works as a factor disadvantageous to increase the area or reduce the fabrication cost. Moreover, in the case of the MIM type, it is necessary to decrease and uniform film thicknesses of an insulating layer and an upper electrode. However, this also works as a factor disadvantageous to increase the area or reduce the fabrication cost. In the case of a surface-conduction-type emitting element, however, it is easy to increase the area or reduce the fabrication cost because the element can be comparatively easily fabricated.

As described above, according to the present invention, an airtight container is formed by jointing a frame to a first substrate by a first jointing material, then disposing a spacer to the first substrate and jointing the frame with a second substrate by a second jointing material having a melting point lower than that of the first jointing material. Therefore, it is possible to use a jointing material having airtightness and a buffering function such as frit glass for the first jointing material while preventing bad influences on the spacer due to heat and increase a container in size. In this case, by pressurizing the upper face of the frame while disposing a spacing definition member to the first substrate, it is possible to use a low-melting-point metal as the material for jointing the second substrate with even a frame member having a dimensional error because the height of the entire upper face of a frame after the frame member is disposed is uniformed, sufficiently reduce bad influences on a spacer due to heat, and form a vacuum container having a high airtightness. Moreover, by disposing the spacing definition member to the outside (portion on the main surface of the first substrate where no airtight container is formed), it is possible to prevent damage to the surface of the substrate inside the location where the frame member is positioned and dust from being produced and fabricate a preferable image-forming apparatus.

Moreover, when a pressurizing member has an elevating unit, a frame can be uniformly pressurized because pressure can be controlled. Therefore, the entire upper face of a frame is not diagonally jointed when assembling the frame and thereby, a preferable image-forming apparatus can be fabricated.

Furthermore, because the second substrate is jointed with the frame member by a low-melting-point jointing material, it is possible to avoid unnecessary activation of a getter material due to the heat under jointing even if the getter material is disposed on the second substrate (face plate) and fabricate a more-preferable image-forming apparatus. Furthermore, though the problem of an insufficient conductance may occur because a spacer is set in a vacuum container, the problem can be solved by disposing a getter to the second substrate and thereby, it is possible to sufficiently exhibit functions of the getter. In this case, by jointing the first substrate with the frame member by the above spacing definition member, jointing can be made at a high-enough positional accuracy even if a member having a positional error (face plate, rear plate, or frame member) is used. Therefore, it is possible to use a low-melting-point metal to joint the second substrate with the frame member, completely avoid unnecessary activation of a getter, allow a dimensional error for a frame member or the like, and increase an image-forming apparatus in size more inexpensively.

What is claimed is:

1. A method for fabricating a vacuum container, comprising:

a step of disposing a frame member on a main surface of a first substrate through a first joining material;

a step of heating and thereby softening the first joining material and then cooling and thereby solidifying the first joining material, and joining the first substrate with the frame member by the first joining material;

a step of disposing a spacer provided with an antistatic-film at a surface thereof on the main surface of the first substrate jointed with the frame member; and a step of disposing a second substrate so as to face the main surface of the first substrate on which the spacer is disposed and joining the second substrate with the frame member by a second joining material having a melting point lower than that of the first joining material, wherein the step of disposing the spacer includes joining the spacer with the first substrate through a third joining material having a softening point lower than that of the first joining material.

2. The method for fabricating a vacuum container according to claim 1, wherein the step of joining the first substrate with the frame member is executed by disposing a spacing definition member having a height larger than that of the frame member but smaller than that of the frame member and the first joining material collectively on the main surface of the first substrate and pressurizing a gap between the first substrate, the frame member, and the spacing definition member, and thereby keeping a height of the frame member and the first joining material collectively and that of the spacing definition member almost the same.

3. The method for fabricating a vacuum container according to claim 2, wherein the spacing definition member is disposed outside of a frame-member disposing position on the main surface of the first substrate.

4. The method for fabricating a vacuum container according to claim 2, wherein gaps between the first substrate, frame member, and spacing definition member are pressurized by an elevating unit.

5. The method for fabricating a vacuum container according to claim 4, wherein the elevating unit has heating means.

6. The method for fabricating a vacuum container according to claim 2, wherein gaps between the first substrate, frame member, and spacing definition member are pressurized by clips.

7. The method for fabricating a vacuum container according to claim 1, wherein the first joining material is frit glass.

8. The method for fabricating a vacuum container according to claim 1, further comprising a step of providing a getter material to the second substrate.

9. The method for fabricating a vacuum container according to claim 1, wherein the second joining material is a low-melting-point metal.

10. A method for fabricating a vacuum container, comprising:

a step of disposing a frame member on a main surface of a first substrate through a first joining material;

a step of heating and thereby softening the first joining material and then cooling and thereby solidifying the first joining material, and joining the first substrate with the frame member by the first joining material;

a step of disposing a spacer provided with an antistatic-film at a surface thereof to a second substrate;

a step of disposing a second substrate on which a spacer is disposed so as to face the main surface of the first substrate joined with the frame member and joining the second substrate with the frame member by a second joining material having a melting point lower than that of the first joining material, wherein the step of disposing the spacer includes joining the spacer with the first substrate through a third joining material having a softening point lower than that of the first joining material.

11. The method for fabricating a vacuum container according to claim 10, wherein the step of joining the first substrate with the frame member is executed by disposing a spacing definition member having a height larger than that of the frame member but smaller than that of the frame member and the first joining material collectively on the main surface of the first substrate and pressurizing a gap between the first substrate, the frame members, and the spacing definition member, and thereby keeping a height of the frame member and the first joining material collectively and that of the spacing definition member almost the same.

12. The method for fabricating a vacuum container according to claim 11, wherein the spacing definition member is disposed outside of a frame-member disposing position on the main surface of the first substrate.

13. The method for fabricating a vacuum container according to claim 11, wherein gaps between the first substrate, frame member, and spacing definition member are pressurized by an elevating unit.

14. The method for fabricating a vacuum container according to claim 13, wherein the elevating unit has heating means.

15. The method for fabricating a vacuum container according to claim 11, wherein gaps between the first substrate, frame member, and spacing definition member are pressurized by clips.

16. The method for fabricating a vacuum container according to claim 10, wherein the first joining material is frit glass.

17. The method for fabricating a vacuum container according to claim 10, further comprising a step of providing a getter material to the second substrate.

18. The method for fabricating a vacuum container according to claim 10, wherein the second joining material is a low-melting-point metal.

19. A method for fabricating a vacuum container, the method comprising:

a step of forming an electron-emitting device on a main surface of a first substrate;

a step of disposing a frame member through a first joining material on the main surface of the first substrate on which the electron-emitting device is formed;

a step of heating and thereby softening the first joining material and then cooling and thereby solidifying the first joining material, and joining the first substrate with the frame member by the first joining material;

a step of disposing a spacer provided with an antistatic-film at a surface thereof on the main surface of the first substrate joined with the frame member; and a step of disposing a second substrate so as to face the main surface of the first substrate on which the spacer is disposed and joining the second substrate with the frame member by a second joining material having a melting point lower than that of the first joining material, the second substrate having on a surface thereof an image forming member which emits light in response to being irradiated with an electron emitted from the electron-emitting device, wherein the step of disposing the spacer includes joining the spacer with the first substrate through a third joining material having a softening point lower than that of the first joining material.

* * * * *

UNITED STATES PATENT AND TRADEMARK OFFICE

CERTIFICATE OF CORRECTION

PATENT NO. : 7,081,029 B2
APPLICATION NO. : 10/166637
DATED : July 25, 2006
INVENTOR(S) : Masahiro Tagawa et al.

It is certified that error appears in the above-identified patent and that said Letters Patent is hereby corrected as shown below:

COLUMN 1

Line 19, “watched” should read --being considered--.

COLUMN 3

Line 7, “function” should read --functions--.

COLUMN 4

Line 45, “second” should read --a second--.

COLUMN 7

Line 30, “dispose” should read --disposed--.

COLUMN 9

Line 35, “clip 92” should read --clips 92--.

COLUMN 10

Line 10, “realize.” should read --realized.--.

COLUMN 11

Line 27, “The” should read --the--.

COLUMN 12

Line 49, “jointed” should read --joined--.

UNITED STATES PATENT AND TRADEMARK OFFICE

CERTIFICATE OF CORRECTION

PATENT NO. : 7,081,029 B2
APPLICATION NO. : 10/166637
DATED : July 25, 2006
INVENTOR(S) : Masahiro Tagawa et al.

It is certified that error appears in the above-identified patent and that said Letters Patent is hereby corrected as shown below:

COLUMN 13

Line 37, "a spacer" should read --the spacer--.
Line 37, "a second" should read --the second--; and
Line 55, "members," should read --member,--.

Signed and Sealed this

Thirteenth Day of May, 2008

JON W. DUDAS
*Director of the United States Patent and Trademark Office*